US005396669A

United States Patent [19]

Nieminen

[11] Patent Number: 5,396,669

[45] Date of Patent: Mar. 14, 1995

[54] TRANSFER AND NURSING SYSTEM FOR A PATIENT

[75] Inventor: Matti Nieminen, Oulu, Finland

[73] Assignee: A. Ahlstrom Corporation, Karhula, Finland

[21] Appl. No.: 64,118

[22] PCT Filed: Nov. 20, 1991

[86] PCT No.: PCT/FI91/00346

§ 371 Date: Jun. 14, 1993

§ 102(e) Date: Jun. 14, 1993

[87] PCT Pub. No.: WO92/08433

PCT Pub. Date: May 29, 1992

[30] Foreign Application Priority Data

Nov. 20, 1990 [FI] Finland ..... 905713

[51] Int. Cl.[6] ..... A61G 7/10

[52] U.S. Cl. ..... 5/83.1; 5/86.1; 5/89.1

[58] Field of Search ..... 5/81.1, 83.1, 86.1, 5/87.1, 88.1, 89.1, 625, 627, 187

[56] References Cited

U.S. PATENT DOCUMENTS

| | | | |
|---|---|---|---|
| 808,785 | 1/1906 | Thompson | 5/89.1 |
| 953,962 | 4/1910 | Lane | 5/87.1 |
| 2,565,761 | 8/1951 | Dean | 5/86.1 |
| 2,899,693 | 8/1959 | Stollenwerk | 5/627 |
| 2,908,916 | 10/1959 | Fischer et al. | 5/86.1 |
| 3,030,638 | 4/1962 | Verduin et al. | 5/83.1 |
| 3,259,922 | 7/1966 | Fischer | 5/86.1 |
| 3,877,089 | 4/1975 | Spivey et al. | 5/81.1 |
| 5,187,821 | 2/1993 | Nieminen et al. | 5/83.1 |

FOREIGN PATENT DOCUMENTS 212779 5/1967 Sweden .

*Primary Examiner*—Michael F. Trettel

*Attorney, Agent, or Firm*—Cohen, Pontani, Lieberman, Pavane

[57] ABSTRACT

A transfer and nursing system for a patient, including a lifting frame having a pair of opposing sides formed by profile bars, the profile bars each having at least two grooves running longitudinally therein. A bearing arrangement is provided for suspending the lifting frame. A lifting sheet and an underlay element are detachably securable to the profile bars of the lifting frame by an arrangement for detachably securing the lifting sheet and the underlay sheet in the grooves of the profile bar so that a plurality of lifting sheets and underlay sheets can be attached to the frame.

12 Claims, 4 Drawing Sheets

TRANSFER AND NURSING SYSTEM FOR A PATIENT

FIELD OF INVENTION

The present invention relates to a system for transferring and nursing a patient, in particular a mobility-impaired patient. The system minimizes the space and the amount of physical labor required for nursing the patient.

PRIOR ART

Working conditions are often problematic when nursing mobility-impaired patients. Lifting the patient is ergonomically difficult for the nurses. Today, there are many kinds of auxiliary equipment available in hospitals for transfer and lifting of patients. Beds which are adjustable in height are generally considered to be the most important of these auxiliary equipment. Also transfer chairs, different lifting devices, for example lifting and transfer devices on legs, bath room lifts, hoists in the cealing, etc. are commonly used. Further, shower chairs, sliding platforms and bath platforms are used for transferring and bathing patients. However, these accesories are single devices designed for a specific use. It may be impractical to use such accessories as they require substantial space and they are not always available at the right time in the right place. In a hurry, the nurses tend to use their own physical force rather than look for auxiliary equipment.

Finnish patent applications no. 892374 and 895127 and WO publication no. WO 91/05532 disclose-hospital beds with a transfer couch and equipment for transfer of a patient. An advantage provided by these systems is that they are integrated parts of the bed and are thus always available. There is no need to fetch many separate auxiliary devices beside the bed when a patient is to be lifted and transferred.

However, a uniform centralized system for nursing a patient has never been suggested whereby a patient can be transferred and nursed starting from the hospital door in such a way that nurses need not lift the patient much which remarkably reduces the physical strain of the nursing work.

DISCLOSURE OF INVENTION

The object of the present invention is to provide a uniform system for facilitation of the transfer and nursing of a patient by which the patient can be transferred and nursed without many separate auxiliary devices and great physical strain.

The transfer and nursing system of the invention comprises a lifting frame serving as a patient transfer couch and connectable to a bearing means and providable with a lifting sheet, with a corresponding underlay element needed for the treatment, and with auxiliary nursing devices. A characteristic feature of the invention is that at least one pair of the opposite sides of the lifting frame is made of profile bars and the lifting sheet or the like couch and/or the auxiliary nursing device is detachably secured by suitable means in grooves provided in the profiles of the bars in such a way that several sheets or couches and/or auxiliary nursing devices may be secured in the frame at the same time.

The bearing means is preferably an integrated part of the hospital bed or the like bed as disclosed for example in WO91/05532.

Lifting frames formed by bars disconnectable from each other are known. Here, the sides of the lifting sheets are provided with tubular portions into which the bars of the lifting frame are slipped; after this the bars of the frame are connected to each other. This method of securing the lifting sheet is, however, very cumbersome and takes time since the lifting frame must be disassembled for a change of the lifting sheet or the like underlay element.

According to the system of the present invention, the lifting sheet can be secured without disassembling the structure of the frame, and further, several different sheets and auxiliary nursing devices, according to what is needed, can be secured to the frame at the same time.

Other features of the invention are defined in the claims which are incorporated herein by reference.

BRIEF DESCRIPTION OF DRAWINGS

The invention is described closer below, by way of example, with reference to the accompanying drawings in which.

DETAILED DESCRIPTION OF DRAWINGS

Figure 1:
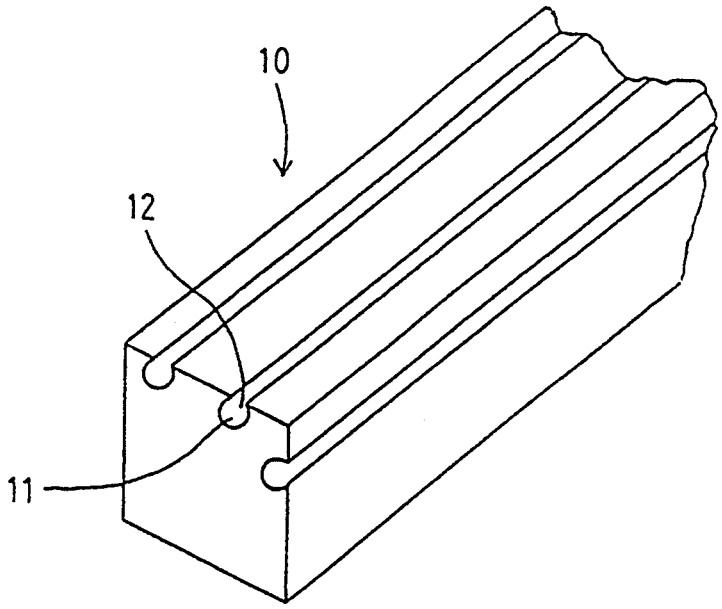
FIG. 1 is a perspective view of the end part of a profile bar of a lifting frame serving as a part of the system according to the invention.
Figure 2A:
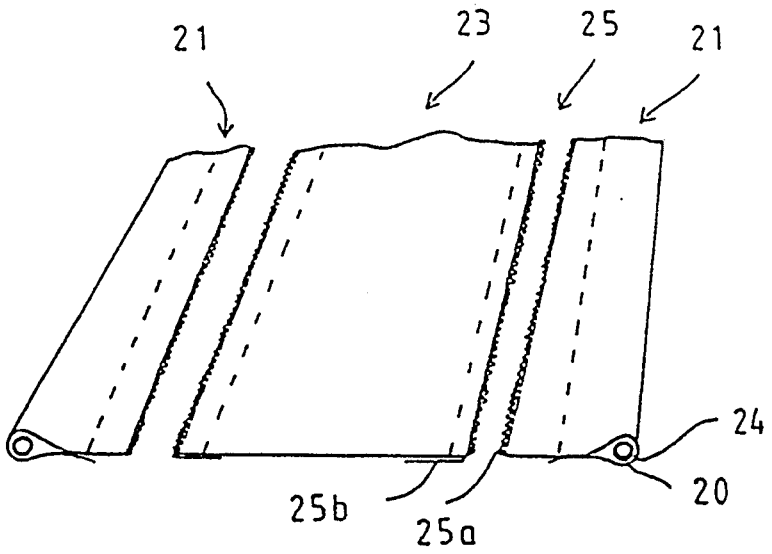
FIGS. 2*a* and 2*b* illustrate means according to the invention for securing a lifting sheet to a lifting frame.

A lifting sheet 23 or the like underlay element can be secured to a profile bar 10 by many different means. FIG. 2*a* illustrates a preferred method of securing the sheet 23 in a groove of the profile bar 10. The securing means comprises an elongate thin piece 20 such as for example a belt, a string, a rod, a plastics pipe or the like member and a strip 21 made of bendable material the length of which preferably corresponds to that of the long side of the lifting sheet 23, one long side of the strip 21 being provided with a tubular portion 24 into which the piece 20 is pushed, and the other long side of the strip 21 being provided with a counter edge 25a of a connecting means 25, by means of which means the strip and the lifting sheet are connected to each other, the other cooperating counter edge 25*b* of the connecting means being provided in the long side of the lifting sheet. The interconnecting means is preferably a zipper. The edge of the strip 21 including the elongate piece 20 is pushed inside a groove 11 from the end of the profile bar (FIG. 1) and the edge comprising the counter edge 25*a* of the interconnecting means, i.e. the half (25*a*) of the zipper, remains outside the groove via a longitudinal slot 12 in the groove and is detachably securable to the zipper half 25*b* in the lifting sheet. This securing method allows fast and simple change of the lifting sheet or the like couch, particularly when one zipper half is usually already installed in both sides of the lifting frame.

Figure 2B:
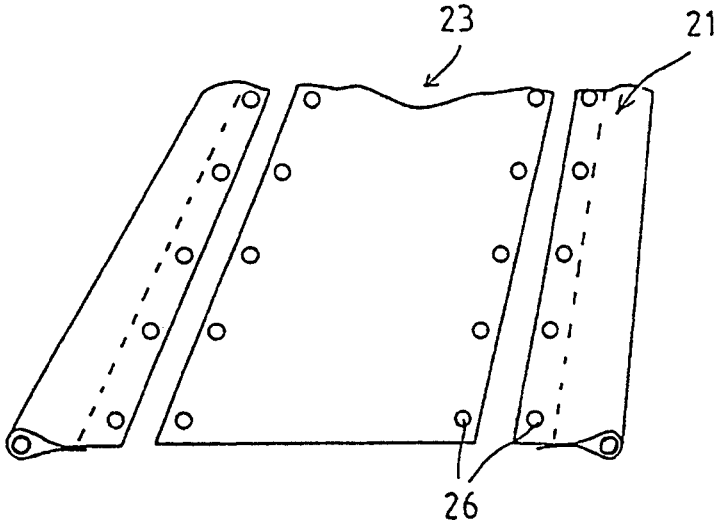

Instead of a zipper, also holes 26 can be provided in the lifting sheet 23 and the strip 23, through which the securing is performed by clips, hooks, lacing etc. (FIG. 2*b*). Alternatively hooks disposed in the groove of the profile bar and connected to holes in the lifting sheet may be used.

Figure 3:
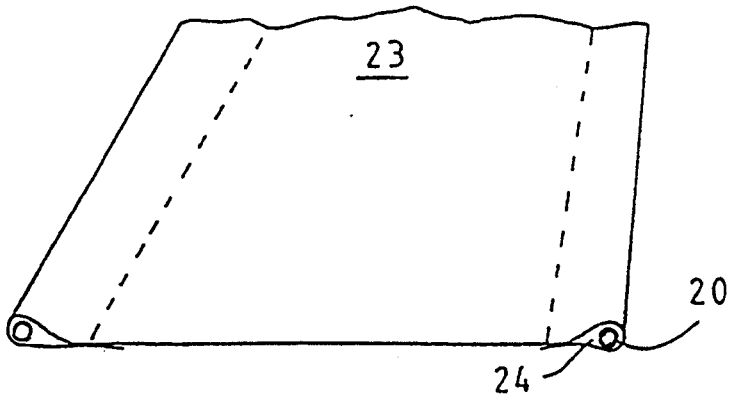
FIG. 3 illustrates another embodiment of means for securing a lifting sheet to a lifting frame.

The elongate piece 20 may also be disposed in a tubular passage 24 provided in the edge of a simple, one-piece lifting sheet 23 (FIG. 3) without interconnecting means along each side. Hereby the sides of the lifting sheet containing the elongate pieces must be fitted into the grooves of the profile bar.

The slot in the groove must be substantially narrower than the diameter of the groove so as to prevent the elongate piece, the hook or the like member disposed in the groove, from slipping out laterally from the groove. The elongate piece or the corresponding member must be so dimensioned that the piece or the member goes easily into the groove but cannot slip out through the slot.

The cross section of the grooves in the bar may be of circular form or, alternatively, be of a triangular, square or a rectangular configuration.

The profile bar may be made of, for example, aluminium, steel or a composite material.

The lifting frame preferably comprises profile bars serving as the long sides of the frame, and shorter sides combining the longer sides and serving as supporting bars.

The function of the transfer and nursing system according to the invention is now described in more detail.

Figure 4:
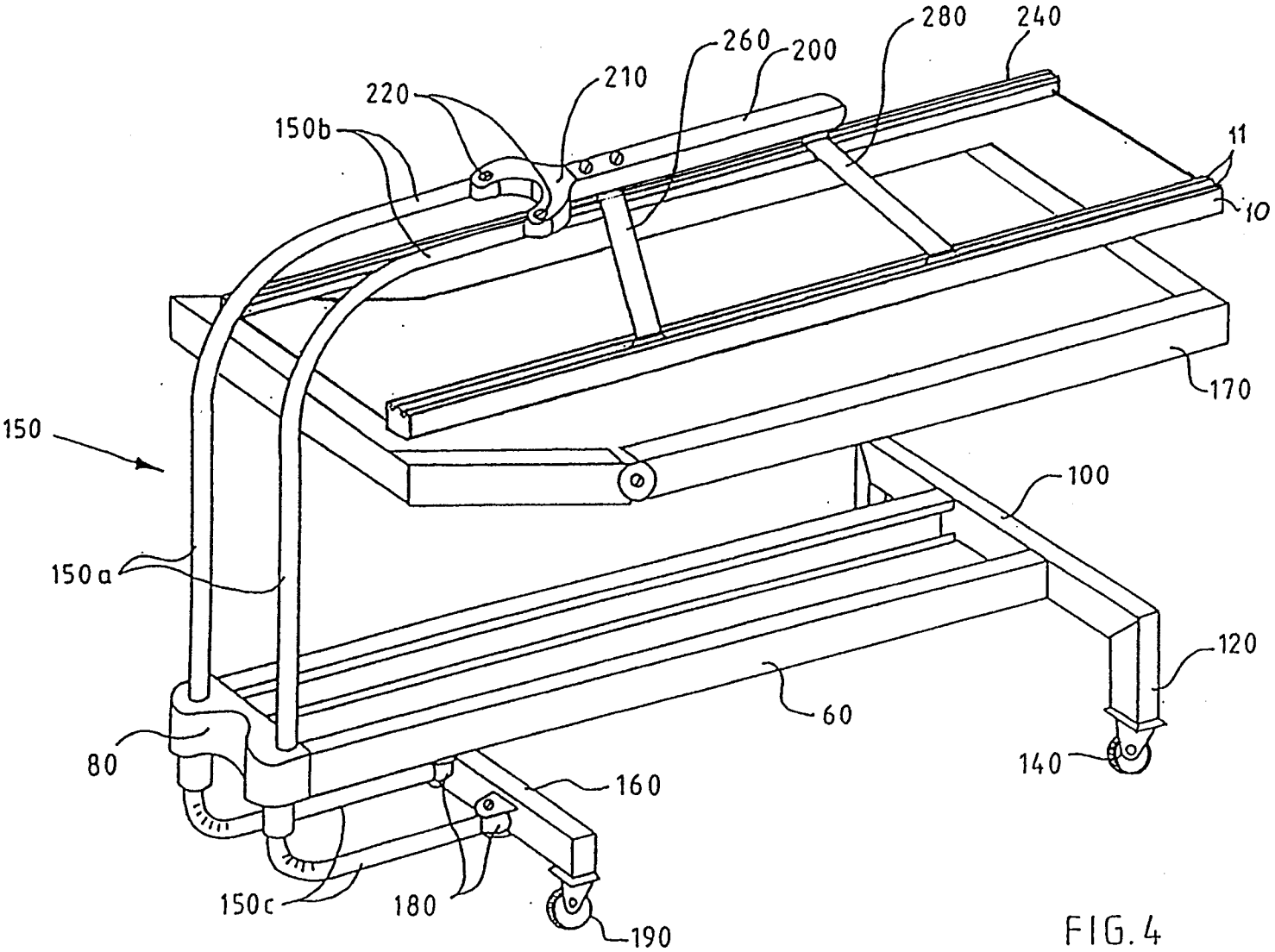
FIG. 4 illustrates a hospital bed in which the system of the present invention can be applied or incorporated.

FIG. 4 illustrates a hospital bed. The bed comprises a body formed by two longitudinal bars 60 and end bars 80 and 100. The end bar 100 at the foot end of the bed is provided with legs 120 and wheels 140. Vertical portions 150*a* of two bearer rods 150 disposed at a distance from each other are turnably mounted in the bar 80 at the head end of the bed. The bearer rods 150 are formed by tubes bent generally to the form of a U and, with the upper generally horisontal arms 150*b* in their initial position, i.e. substantially parallel with the longitudinal axis of the bed, the bearer rods extend to a position over the patient-supporting portion 170 of the bed. In their initial position, lower arms 150*c* of the bearer rods extend to a distance under the longitudinal bars 60. The ends of the lower arms 150*c* are connected to each other by a transverse bar 160 via articulated joints 180. The transverse bar 160 is provided with wheels 190. The ends of the upper arms 150*b* are connected to each other by a fork portion 210 of a bearer beam 200 via articulated joints 220.

The bed further comprises a transfer couch, a lifting frame 240, which in the position illustrated in the figure is supported by straps 260 and 280 but in its initial position is supported by the patient-supporting portion 170 of the bed. The opposing sides, preferably the longer sides of the lifting frame are made of profile steel and are illustrated in FIG. 1.

The above way of connecting the bearer rods 50 to each other ensures that the bearer rods 150 are pivotable about their vertical axes in parallel direction and also that the bearer beam 200 retains its orientation parallel to the direction of the longitudinal axis of the bed when the beam is moved sideways.

A patient brought to the hospital on a stretcher is lifted onto a lifting sheet 23 placed on a transport trolley and the trolley is brought beside a bed of the type described above. For the patient to be transferred from the transport trolley onto the bed, the bearing means and the lifting frame 240 connected thereto are turned beside the bed and the lifting sheet 23 under the patient is secured to the profile bars 10 forming the longitudinal sides of the lifting frame 240. The lifting frame is then, supported by the bearer rods 150, pivoted over the bed and the patient-supporting portion 170 of the bed is raised to its upper position by a raising device (not shown) to receive the patient. The straps 260 and 280 are then detached from the lifting frame 240. Thus, it has not been necessary for the nurses to lift the patient but it still has been possible to transfer the patient to the bed.

Figure 5:
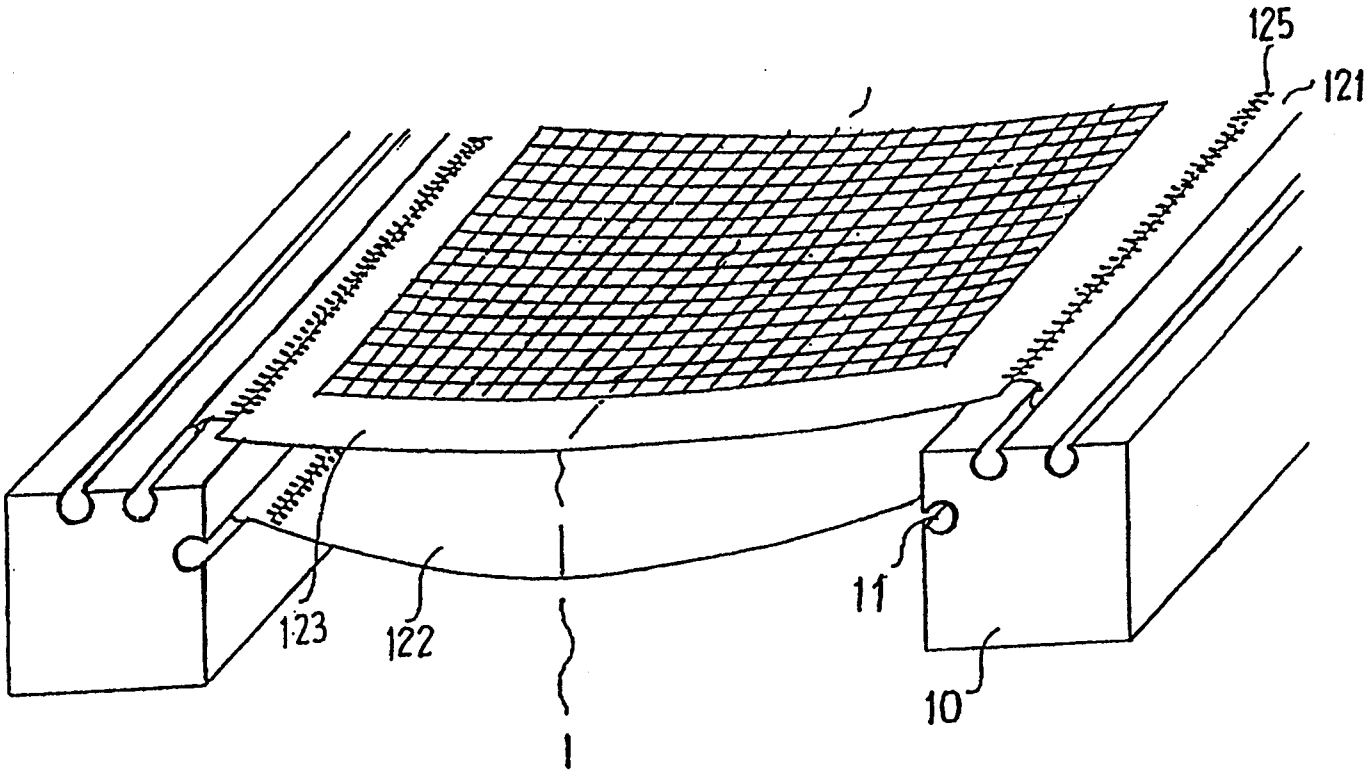
FIG. 5 illustrates two elements supported by the frame simultaneously.

The system of the invention can be employed, in addition to transferring patients, also during various nursing operations, for example during bathing of the patient. FIG. 5 illustrates a water-pervious sheet 123 with connection means (a strip 121 and a sipper 125), for example a polyester mesh coated with PVC, which sheet is replaced in the lifting frame for the bathing operation. An advantage provided by the lifting frame according to the invention is that a sheet can be replaced in it without having to disassemble the structure of the lifting frame. The sheet can be replaced without transferring the patient from the lifting frame. For washing operations the frame is provided with a water-impervious element 122 for collecting the washing water.

For the bathing operation the frame on the patient-supportion portion of the bed is suspended in the bearer beam with the straps. The lifting sheet under the patient is disconnected at one side from the lifting frame to which it is preferably secured via a zipper. One side of the washing mesh is secured to the frame. The patient is turned over whereby the lifting sheet can be rolled up and the washing mesh rolled out. When the patient is turned over to his or her other side the rest of the lifting sheet can be rolled up and removed from the frame, and the rest of the washing mesh can be rolled out and secured to the profile bar of the lifting frame. Turning the patient over does not require much physical strength as the strap suspension of the frame allows a rocking motion which can be utilized to facilitate the turning of the patient. When the patient is bathed the water runs down through the washing mesh and is collected in the water-impervious element thereunder, provided with an opening into which a hose has been connected for discharging the water for example to a floor drain. Thus the patient need not lie in the bathing water which he or she must do in systems in which a separate water-pervious mesh cannot be used. Subsequent to the bathing the patient is wrapped in a towel and the washing mesh is replaced by another lifting sheet in the way described above. Thus the patient has been bathed and the nurses have not been compelled to lift or transport the patient.

The system can be applied in a corresponding way also in other nursing operations as it is easy to change the lifting sheet. Further the system of the invention allows securing various auxiliary devices in the frame such as skull or limb tension arrangements and infusion equipment. These devices, which are known as such, are secured via an adapter in the groove of the profile bar. For example a limb tension patient has previously been confined to bed in such a way that it has been very difficult to nurse him or her. Due to the system of the present invention, the patient is no longer confined to bed but only to the lifting frame on which he or she can be lifted and moved and nursed in the way described above.

The present invention contributes to centralization of the basic nursing operations in one place. This minimizes the need to transfer the patients and thus the physical strain of the transfer on the nursing personnel.

The invention is not limited by the embodiments described above which are presented as examples only but it can be modified in various ways within the scope of protection defined by the appended patent claims.

We claim:

1. A transfer and nursing system for a patient, comprising: a lifting frame having a pair of opposing sides formed by profile bars, the profile bars each having at least two grooves running longitudinally therein; bearing means for suspending the lifting frame; a first underlay element securable to the profile bars of the lifting frame; a second underlay element securable to the profile bars of the lifting frame; and means for detachably securing the first and second elements in the grooves of the profile bar so that a plurality of underlay elements can be attached to the frame.

2. A system according to claim 1, wherein the lifting frame has longitudinal sides that are formed by profile bars.

3. A system according to claim 1, wherein the grooves in the profile bars are tubular with a laterally opening slot.

4. A system according to claim 1, wherein the grooves in tile profile bars have a generally circular section with a laterally opening slot.

5. A system according to claim 1, wherein the means for securing the underlay elements include an elongate thin member and a bendable strip member having one side provided with a passage into which the elongate member is receivable, the securing means further including interconnecting means for securing the strip member to the first underlay element, the interconnecting means including two interengageable counter parts, a first of the counter parts being provided on another side of the strip member and a second of the counter parts being provided on the first underlay element.

6. A system according to claim 1, wherein the elongate thin member is one of a belt, a string, a rod, and a plastic pipe.

7. A system according to claim 5, wherein the interconnecting means is a zipper.

8. A system according to claim 1, wherein each underlay element has a tubular passage, the securing means including an elongate member disposable in the tubular passage of the lifting sheet.

9. A system according to claim 8, wherein the elongate member is one of a belt, a string, a rod, a plastic pipe, and an edge bead.

10. A system according to claim 1, wherein each profile bar has at least two longitudinal grooves that define an opening with a reduced diameter relative to a larger diameter portion so as to receive and hold an enlarged portion of the side of the first and the second underlay elements.

11. A system according to claim 1, wherein the securing means includes two edge strip members detachably connectable to the first and the second underlay elements and being engageable in the grooves of the profile bars.

12. A system according to claim 1, wherein the first underlay element is a lifting sheet.

* * * * *